US010801089B2

(12) United States Patent
Gartner et al.

(10) Patent No.: US 10,801,089 B2
(45) Date of Patent: Oct. 13, 2020

(54) LIGHT METAL CAST COMPONENT

(71) Applicant: Mubea Performance Wheels GmbH, Salzburg (AT)

(72) Inventors: Josef Gartner, Mining (AT); Werner Hubauer, Tumeltsham (AT)

(73) Assignee: Mubea Performance Wheels GmbH, Salzburg (AT)

( * ) Notice: Subject to any disclaimer, the term of this patent is extended or adjusted under 35 U.S.C. 154(b) by 277 days.

(21) Appl. No.: 15/770,325

(22) PCT Filed: Oct. 31, 2016

(86) PCT No.: PCT/EP2016/076218

§ 371 (c)(1),
(2) Date: Apr. 23, 2018

(87) PCT Pub. No.: WO2017/076801

PCT Pub. Date: May 11, 2017

(65) Prior Publication Data

US 2018/0305793 A1 Oct. 25, 2018

(30) Foreign Application Priority Data

Nov. 2, 2015 (EP) ..... 15192538

(51) Int. Cl.

| | |
|---|---|
| ***B22D 21/00*** | (2006.01) |
| ***B22D 18/02*** | (2006.01) |
| ***B22D 18/04*** | (2006.01) |
| ***C22C 21/02*** | (2006.01) |
| ***C22F 1/043*** | (2006.01) |
| ***B22D 1/00*** | (2006.01) |
| ***C22F 1/04*** | (2006.01) |

(52) U.S. Cl.

CPC ..... *C22C 21/02* (2013.01); *B22D 1/00* (2013.01); *B22D 18/02* (2013.01); *B22D 18/04* (2013.01); *B22D 21/007* (2013.01); *C22F 1/04* (2013.01); *C22F 1/043* (2013.01)

(58) Field of Classification Search

CPC ..... B22D 1/00; B22D 18/02; B22D 18/04; B22D 21/00; B22D 21/007; C22C 21/02; C22F 1/04; C22F 1/043

USPC ..... 164/120, 71.1, 55.1, 57.1; 428/544; 420/590

See application file for complete search history.

(56) References Cited

U.S. PATENT DOCUMENTS 10,022,780 B2 * 7/2018 Hubauer ..... B22D 39/00

FOREIGN PATENT DOCUMENTS

| | | | |
|---|---|---|---|
| DE | 4327227 | A1 | 2/1995 |
| DE | 69233286 | T2 | 11/2004 |
| DE | 10 2006 039684 | A1 | 2/2008 |
| DE | 102006039684 | B4 | 8/2008 |
| EP | 0488670 | A1 | 6/1992 |
| EP | 0601972 | A1 | 6/1994 |
| EP | 1244820 | B1 | 7/2006 |
| EP | 2479296 | A1 | 7/2012 |
| EP | 2653579 | A1 | 10/2013 |
| EP | 2848333 | A1 | 3/2015 |
| JP | H05 171327 | A | 7/1993 |
| JP | H11 293430 | A | 10/1999 |
| JP | 2001-073056 | A | 3/2001 |
| JP | 2001288547 | A | 10/2001 |
| JP | 2005-272966 | A | 10/2005 |
| JP | 2013-215756 | A | 10/2013 |
| JP | 2015-057294 | A | 3/2015 |
| WO | 2001042521 | A1 | 6/2001 |

OTHER PUBLICATIONS

Alemdag, Yasin and Beder, Murat: "Microstructural, mechanical and tribological properties of A1—7Si—(0-5)Zn allloys", Materials and Design, vol. 63, 2014, XP002764402, p. 160.

"Kornfeinung" In: Rheinfelden Alumninium: "Hüttenaluminium-Gusslegierungen Rheinfelden Alloys", Jan. 2010 (Jan. 2010), Aluminium Rheinfelden, XP002756661, pp. 90-92 no translation available.

Spiekermann, P: "Alloys—a special problem of patent law", Nonpublished English translation of document, 1991, pp. 1-20, XP002184689.

International Search Report and Written Opinion for PCT/EP2016/076218 dated Jan. 23, 2017 (with English translation; 14 pages).

* cited by examiner

*Primary Examiner* — Kevin P Kerns

(74) *Attorney, Agent, or Firm* — Bejin Bieneman PLC

(57) ABSTRACT

A method includes producing a light metal cast component from a melt of an aluminium casting alloy. The alloy contains, by weight, silicon with 3.5 to 5.0%, magnesium with 0.2 to 0.7%, titanium with 0.07 to 0.12%, boron with a maximum of 0.012%, and optionally further alloy elements together with less than 1.5%, the rest, aluminium as well as unavoidable impurities, wherein the melt is produced from a base melt, a first grain refiner of an aluminium-silicon alloy and a second grain refiner of an aluminium-titanium-alloy, wherein the melt, in relation to the total weight, contains in total an amount of 0.1 to 5.0% of the first and the second grain refiner; wherein the casting is carried out by a low-pressure method and the melt is acted upon by compacting after the casting.

20 Claims, 1 Drawing Sheet

LIGHT METAL CAST COMPONENT

CROSS-REFERENCE TO RELATED APPLICATIONS

This application is a national stage of, and claims priority to, Patent Cooperation Treaty Application No. PCT/EP2016/076218, filed on Oct. 31, 2016, which application claims priority to European Application No. EP 15192538.5, filed on Nov. 2, 2015, which applications are hereby incorporated herein by reference in their entireties.

BACKGROUND

The present trend in the motor vehicle industry toward light weight design and passenger protection leads increasingly to the development of high-strength and very high-strength components that have a lower weight than conventional components having at least the same strength properties. It is known that alloy wheels for motor vehicles can be manufactured by casting or forging. The requirements for the casting molds and the alloy used differ for forging and for casting.

Forged alloy wheels have an extraordinary strength that allows a slimmer and lighter design than for comparable steel rims. Furthermore, because of the high strengths, relatively thin walls and spokes can be designed, resulting in a low weight. The production usually takes place by permanent mold casting from a forging alloy. The permanent mold is generally flat and approximately corresponds to the end product only in the diameter. After the casting, the blank is pressed into a mold at approximately 500° C. stepwise with up to two-thousand tons pressure force. Thereby, the actual inner rim is finished. Then the rim well is produced by means of rolling and a machining process is carried out. Compared with cast wheels, forged wheels are a lot stronger, alloyed with strength-increasing alloy elements like magnesium, silicon and titanium.

In the case of casting, the shape of the permanent mold is formed closely to the final shape of the component to be produced. According to one possibility, the casting can be carried out in a low-pressure casting with approximately 1 bar upwards. Alternatively thereto, also a pressure casting method can be used for this, in which the liquid melt is pressed with high pressure of approximately 10 to 200 MPa into a pre-heated permanent mold, where it then solidifies. The melt displaces the air present in the permanent mold and is held during the solidification process under pressure. After removing from the permanent mold, the component is machined. Cast wheels, compared with forged wheels, usually have only a very low amount of foreign metals like titanium.

In components produced with the casting method, the casting properties of the metal alloys and the mechanical properties of the finished component depend essentially on the grain size. By means of grain refining melt treatment, the static and dynamic strength values in the cast pieces and the pouring ability of the melt in the permanent mold as well as its flow behaviour can be improved. The solidification of many metal alloys starts with the forming of crystals, which starting from the nucleus points grow to all sides, until they collide with the neighbouring grain or abut the mold wall.

For a high strength of the component to be produced it is desirable to adjust the size of the grains as constantly and/or as finely as possible. For this, a so-called grain refinement is often carried out, wherein as many nucleating agents (foreign nuclei) as possible are provided to the solidifying melt.

From JP H11 293430 A a method for producing a high-strength cast aluminium component is known. After the casting, the cast aluminium component has a composition, each in terms of weight, of 3.5 to 5.0% silicon, 0.15 to 0.4% magnesium, up to 1.0% copper, up to 0.2% iron, treatment means and the rest aluminium. After the casting the cast component is heated at 550° C. to 575° C. for a time of two to four hours, then is quickly cooled down and then is subjected to a further heat treatment at 160° C. to 180° C. for a time of one to three hours.

From JP H05 171327 A an aluminium casting alloy for high pressure casting is known, which has a composition, each relative to the weight, of 4.0 to 6.0% silicon, 0.3 to 0.6% magnesium, up to 0.5% iron, 0.05 to 0.2% titanium. The alloy can be used for casting motor vehicle wheels.

From JP 2001 288547 A an aluminium casting is known with a composition, each relative to the weight, of 2.0 to 6.0% silicon, 0.15 to 0.34% magnesium, up to 0.2% iron, 0.0003-0.01% strontium, the rest aluminium and unavoidable impurities, and with, as the case may be, 0.01 to 0.25% titanium and 0.0001 to 0.001% boron. After the casting the component is subjected to a solution annealing at 540° C. to 570° C. for 15 to 60 minutes and is then quenched.

From EP 0 488 670 A1 an aluminium cast with high strength is known, with, each relative to the weight, 2.4 to 4.4% silicon, 1.5 to 2.5% copper, 0.2 to 0.5% magnesium and the rest aluminium, wherein the matrix of the aluminium casting contains dendrites with a grain size of 30 micrometers or less.

From DE 10 2006 039 684 B4 an aluminium safety component for automotive engineering is known, which is produced from an aluminium-silicon-pressure casting alloy. The pressure casting alloy has 1.0 to 5.0 percent by weight silicon, 0.05 to 1.2 percent by weight chromium and the rest aluminium and unavoidable impurities. Because of the chromium, an improved castability and moldability should be achieved. The pressure casting alloy can furthermore have titanium with a content of 0.01 to 0.15 percent by weight, wherein titanium acts as grain refiner, in particular when it is used together with boron.

From EP 0 601 972 A1 a hypoeutectic aluminium-silicon-casting alloy is known, which contains a master alloy as grain refinement substance. The casting alloy comprises a silicon content of 5 to 13 percent by weight and can further comprise magnesium with a content of 0.05 to 0.6 percent by weight. The master alloy contains 1.0 to 2.0 percent by weight titanium and 1.0 to 2.0 percent by weight boron. The aluminium-silicon-casting alloy is used for producing rims for motor vehicles by means of low-pressure permanent mold casting. The adding of the master alloy takes place, in relation to the total amount of melt, by an amount of 0.05 to 0.5 percent by weight.

From DE 692 33 286 T2 a method for grain refinement of aluminium and aluminium alloys is known, for example, in which a solid silicon-boron-alloy is added to molten aluminium or a molten aluminium-alloy. The resulting melt contains approximately 9.6 percent by weight silicon and at least 50 ppm boron. The component, produced from the melt, has grain sizes in the range of 300 micrometers.

From EP 1 244 820 B1 a method for grain refinement of high-strength aluminium casting alloys is known, to achieve a cast product with a grain size of less than 125 micrometers. For this, different alloys are proposed, for example an alloy with more than 3.8 percent by weight copper, maximal 0.1 percent by weight silicon and 0.25 to 0.55 percent by weight magnesium, or an alloy with more than 4.5 and less than 6.5 percent by weight zinc, maximal 0.3 percent by weight silicon and 0.2 to 0.8 percent by weight magnesium. For the grain refinement, dissolved titanium with a grain size of less than 125 micrometers in an amount of 0.005 to 0.1 percent by weight as well as boride are added to the melt.

From WO 2001 042521 A1 a method for producing a grain refinement substance on the basis of an aluminium-titanium-boron-master alloy is known by means of adding titanium-containing and boron-containing starting materials into an aluminium melt with forming TiB2-particles and solidifying this master alloy melt. In a reference cited there, a theory concerning the course of the processes during the grain refinement of aluminium alloys by adding an Al—Ti—B-master alloy is described, for example AlTi5B1. According thereto, the best grain refinement results are achieved when the TiB2-particles which are insoluble in the aluminium melt are occupied at their surface at least partially by a layer of Al3Ti-phase. The nucleation of the alpha-aluminium-phase is achieved on the Al3Ti-layers, which effect increases with decreasing layer thickness.

From EP 2 848 333 A1 a method for producing a metal component by means of a casting- and forming tool is known with the steps: casting a melt into the casting- and forming tool at a first pressure, applying a pressure on the solidifying melt in the tool with a larger second pressure and compacting the component, solidified from the melt, in the tool with a larger third pressure.

SUMMARY

Disclosed herein is a light metal cast component, in particular for a motor vehicle, which is produced from a hypoeutectic aluminium casting alloy, and a method for producing such a light metal cast component. The light metal cast component has a fine grain structure that has good strength properties and is easy to produce.

A light metal cast component can be produced from a hypoeutectic aluminium casting alloy, wherein the light metal cast component contains 3.5 to 5.0 percent by weight silicon and 0.2 to 0.7 percent by weight magnesium, and wherein the light metal cast component has an average grain size of maximal 500 micrometers. It is provided in particular that the light metal cast component contains, besides silicon and magnesium with the stated amounts, also titanium with 0.07 to 0.12 percent by weight, boron with maximal 0.012 percent by weight, optionally further alloy elements with together less than 1.5 percent by weight and the rest aluminium as well as unavoidable impurities.

An advantage of the light metal cast component is that it is producible by means of low pressure casting due to the relatively low silicon amount, and that it has good mechanical properties due to the fine grain structure in particular view of the strength, ductility, elongation at fracture and porosity.

The tensile strength (Rm) of the light metal cast component is preferably at least 270 N/mm$^2$, in particular at least 300 N/mm$^2$ and/or at least 320 N/mm$^2$.

Because of the relatively low silicon amount of less than 5 percent by weight, a hypoeutectic aluminium-silicon-alloy is achieved. The cast light metal component produced therefrom has a high ductility and elongation at fracture. The elongation at fracture (A5) of the light metal cast component is at least 5%, in particular at least 8%. The elongation at fracture can be below the elongation of fracture typical for a forged part, in particular below 12%.

The cast light metal component preferably has a yield strength (Rp0.2) of at least 220 N/mm$^2$, in particular of at least 250 N/mm$^2$, more specifically of at least 280 N/mm$^2$.

The cast light metal component can have a maximal porosity of less than 0.5%, in particular less than 0.1%. The low porosity contributes to good strength properties and ductility. The cast light metal component can have a surface roughness of less than 50 micrometers, in particular less than 20 micrometers.

The low surface roughness of less than 50 micrometers contributes to especially good mechanical properties of the surface finish of the component. According to an embodiment the light metal cast component has a yield strength (Rp0.2) of at least 280 N/mm$^2$, an elongation at fracture (A5) of at least 8% as well as a tensile strength (Rm) of at least 320 N/mm$^2$ in a raw casting surface area. In this case, raw casting surface area means an area of the raw cast component that is unmachined after the casting, with a depth of up to 1.0 mm from the component surface.

After solidification, the light metal cast component can be subjected to a heat treatment, in particular a solution heat treatment, and then followed by aging. The heat treatment contributes to an improvement of the named material properties, in particular to an increase of the strength. The above named material properties relate in particular to a condition after having carried out heat treatment.

Main alloy elements of the casting alloy used for producing the light metal cast component are aluminium and silicon. The casting alloy can also be referred to as aluminium-silicon-casting alloy.

The casting alloy can include, besides aluminium, silicon and manganese additional alloy elements and unavoidable impurities, respectively. The proportion of further alloy elements and unavoidable impurities is in particular less than 1.5 percent by weight relative to the total weight of the light metal casting, in particular less than 1.0 percent by weight by weight. According thereto, the aluminium-silicon-casting alloy has in particular at least 93 percent by weight, preferably at least 95 percent by weight aluminium.

Generally, it is desirable that the to-be-produced light metal cast component has good mechanical properties, in particular a high strength. On the other hand, strength increasing alloy elements can lead to an increased tendency of corrosion, which again is not desired.

Therefore it is provided in particular that the proportion of strength-increasing alloy elements is as low as possible, so that the light metal cast component has a high resistance to corrosion. The resistance to corrosion should be so high that the relevant corrosion tests for the respective light metal cast component are met. Standardised corrosion tests are for example described in EN ISO 9227 or ASTM B117. Depending on the component, also corrosion tests which relate to the external stresses of motor vehicles, like CASS-test (copper accelerated salt spray test) and/or the Filiform-test of motor vehicle wheels, should be met. The CASS-test is carried out in particular for coated or varnished components. In this case, the to-be-tested components are subjected permanently to different, high corrosive salt sprays in a box-like plant. The examination of the filiform-corrosion can for example be carried out according to DIN EN 3665 or a comparable standard.

The subcritical amount of strength increasing alloy elements depends on the respective alloy composition and the corrosion test that is used, and therefore cannot be stated in an absolute or precise manner. Therefore, it can only be stated in an exemplary manner that the proportion of strength increasing alloy elements like copper (Cu), zinc (Zn) and titanium (Ti) can be in total lower than one percent by weight relative to the total weight of the component.

In an embodiment the aluminium-casting alloy can have copper (Cu) with a maximal amount of 1.0 percent by weight, in particular maximal 0.5 percent by weight, in particular up to 550 ppm (parts per million). It can also be provided, that the casting alloy and, respectively, the component produced therefrom contains less than 250 ppm or even no copper.

In an embodiment, the aluminium-casting alloy can have zinc (Zn) with a maximal content of 550 ppm (parts per million). It can also be provided that the casting alloy and, respectively, the component produced therefrom, contains less than 250 ppm or no zinc.

In an embodiment the aluminium-casting alloy can have titanium (Ti) with a maximal content of 0.12 percent by weight. In particular, it can be provided that an amount of 0.07 to 0.12 percent by weight titanium is contained in the casting alloy and, respectively, in the component produced therefrom.

In an embodiment the aluminium-casting alloy can have boron (B) with a maximal content of 0.12 percent by weight, in particular at most 0.012 percent by weight, in particular at most 0.06 percent by weight. If also titanium is provided, the amount of boron can be below the amount of titanium. According to an embodiment, the titanium and the boron can also be provided in the form of titanium boride in the aluminium-casting alloy and, respectively, in the component produced therefrom. In particular, the aluminium-casting alloy can have titanium boride (TiBor) with an amount of less than 30 ppm.

According to an embodiment the aluminium-casting alloy can contain strontium (Sr) with an amount of 100 ppm to 150 ppm.

According to an embodiment the aluminium-casting alloy can contain tin (Sn) with an amount of less than 250 ppm.

According to an embodiment the aluminium-casting alloy can contain nickel (Ni) with an amount of less than 550 ppm.

According to an embodiment the aluminium-casting alloy can contain manganese (Mn) with an amount of less than 0.5 percent by weight.

According to an embodiment the aluminium-casting alloy can contain chromium (Cr) with an amount of less than 500 ppm, e.g., less than 200 ppm. This especially includes also the possibility that no chromium is contained in the aluminium-casting alloy, and/or in the component produced therefrom. This is also valid for the remaining above named alloy elements.

According to an embodiment the aluminium-casting alloy can contain iron (Fe) with an amount of less than 0.7 percent by weight.

According to an embodiment the aluminium-casting alloy can contain manganese (Mn) with an amount of less than 0.15 percent by weight.

It is to be understood that all the named alloy elements can be provided on their own or also in combination with one or more other elements. The rest of the aluminium-casting alloy comprises aluminium, silicon, magnesium, further in particular titanium and boron and unavoidable impurities. The weight proportion of the other alloy elements, i.e., of the alloy elements present besides aluminium, silicon, magnesium, titanium and boron, are preferably less than 1.5, in particular less than 1.0 percent by weight.

An advantage of the presently disclosed light metal cast components is that they have a larger design freedom than conventional light cast metal components and light metal forgings. Thus, smaller cross-sections of the components can be achieved and/or a cumbersome post-processing-forming technique can be omitted. According to an embodiment, the light metal cast component can have in the finished condition partial portions, which after the casting are mechanically unmachined, in particular mechanically non-compacted. The mechanically unmachined portions can have a wall thickness of less than 3.0 millimeters at least in partial portions.

According to a possible embodiment, the light metal cast component can be a safety- or structural component, in particular a vehicle wheel or a vehicle rim for a motor vehicle or the same. In this case, it is understood that the light metal cast component can also be designed in a different form or for other applications than for motor vehicles, for example for the construction industry. Preferably, the safety- or structural component has a weight of at least 500 grams, in particular at least 3000 grams.

A method for producing a light metal cast component includes the steps of: providing a melt from an aluminium-casting alloy, which contains—besides aluminium—at least silicon with 3.5 to 5.0 percent by weight and magnesium with 0.2 to 0.7 percent by weight as well as unavoidable impurities; casting the melt into a casting- and forming tool with a low first pressure (P1); after completely filling the casting- and forming tool, applying a pressure on the solidifying melt in the casting- and forming tool with a second pressure (P2) that is larger than the first pressure (P1); and when the melt is at least mostly solidified to the component, compacting of the component, at least mostly solidified from the melt, in the casting- and forming tool at a third pressure (P3) that is larger than the second pressure (P2).

An advantage of the described casting method is that therewith components with an especially high strength and an especially fine structure can be produced in a short time. With the method, in particular light metal cast components can be produced with an average grain size of less than 500 micrometers, in particular between 200 to 500 micrometers. The advantages of the method apply to the component produced according to the method and vice-versa.

A further advantage of the method is that the produced component has a near-net shape due to the compacting, which leads to exceptional material utilisation. Furthermore, the products produced with the named method have a high dimensional accuracy and surface quality. The tool costs are low, as the different process steps are carried out with one tool. The method is especially suitable for producing wheel rims for motor vehicles, wherein the production of other components is of course not excluded.

According to a preferred process embodiment the casting of the melt takes place at a temperature clearly above the liquidus temperature, in particular at a casting temperature which is at least 10% above the liquidus temperature. For example, the melt including the aluminium-casting alloy, can be casted at a temperature of 620° C. to 800° C., in particular at a temperature of 650° C. to 780° C. The casting tool, which is also designated as casting mold or permanent mold, can have a low temperature compared therewith of for example below 300° C.

The pressure, necessary for pouring the melt into the casting tool depends on the casting method, wherein for example gravity casting or low-pressure casting can be considered. When using gravity casting, the first pressure can for example be ambient pressure, i.e. approximately 0.1 MPa (1 bar). Compared thereto, when using low pressure casting, the first pressure is correspondingly so high that the melt can rise through the riser into the hollow molding space of the casting tool. For example, the pressure during low pressure casting can be between 0.3 MPa to 0.8 MPa (correspondingly 3 to 8 bar). The first pressure is at most as large as it is necessary for a low pressure casting and should preferably be below 1 MPa.

The pressure application provided after filling the casting tool is carried out at a higher second pressure, which can for example be larger than 5 MPa (50 bar), in particular more than 9 MPa (90 bar). The pressure application with the second pressure starts after the casting mold is completely filled with the melt, in particular while the melt initially solidifies to the component and/or when the melt begins to cross over to the semi-solid-state. In case of the low pressure method, the completely filled condition of the casting mold can be detected for example by a pressure surge on the filling piston.

The pressure application of the solidifying melt can for example take place at a component-surface-layer-temperature below the liquidus line and/or above the solidus line of the light metal alloy. It is however also possible, that the process already starts before reaching the liquidus line, for example at 3% above the liquidus line. The component-surface-layer-temperature is in this connection to be understood as a temperature, that the component has in a surface layer portion, and/or an surface layer solidifying or solidified from the melt. The solidification takes place from the outside inwards, so that the temperature of the solidifying component is higher inside than in the surface layer. The pressure application is carried out at a second pressure, which is larger than the first pressure and can for example be exerted by the own weight of the upper part onto the melt.

For compacting, an even higher third pressure is produced and applied onto the workpiece, which can preferably be more than 15 MPa (150 bar). The compacting can be carried out at a component-surface-layer-temperature that is lower than the second temperature of the light metal alloy, already partially or mostly solidified. A lower boundary of the third temperature for carrying out the compacting can be at half of the solidus temperature of the metal alloy. Partial portions of the component can also be outside of the temperature. During the compacting the temperature of the component, respectively of the lower tool part and/or upper tool part can be monitored by means of corresponding temperature sensors. The end of the forming process can be defined by reaching an end position of the relative movement of the upper part relative to the lower part and/or by reaching a specific temperature.

According to a possible process embodiment, the melt can be produced from a base melt that at least contains aluminium and grain refining substances. The grain refining substances act during the crystallisation of the light metal alloy as nucleating agents. These nucleating agents have a higher melting point than the light metal melt to be cast and therefore solidify first during the cooling. Crystals formed from the melt, attach themselves easily to the grain refining substances. As many as possible crystals are produced, which then impede each other's growth, so that as a whole a fine regular structure is produced. The grain refining substances can comprise a grain refiner of an aluminium-silicon-alloy, which contains an amount of silicon of maximal 12.5 percent by weight, and/or a grain refiner of an aluminium-titanium-alloy, which contains as alloy elements at least titanium and boron. It is provided in particular that the two grain refiners are composed of different alloys. An especially good grain refinement effect is achieved, when the first grain refiner with up to 12.5 percent by weight silicon as well as the second grain refiner with titanium and boron are used. This leads to a clear improvement of the castability and of the strength of the component produced therefrom.

In a more detailed embodiment the melt can contain, relative to the total weight of the ready-to be poured melt, respectively of the component produced therefrom, together an amount of 0.1 to 5.0 percent by weight of the grain refiner of the aluminium-silicon-alloy and of the grain refiner of the aluminium-titanium-alloy.

It is provided in particular that the melt of the aluminium-casting alloy, respectively the light metal cast component produced therefrom, contains silicon with 3.5 to 5.0 percent by weight, magnesium with 0.2 to 0.7 percent by weight, titanium with 0.07 to 0.12 percent by weight, boron with maximal 0.012 percent by weight, optionally further alloy elements with together less than 1.5 percent by weight, the rest aluminium as well as unavoidable impurities.

As far alloy elements like silicon, titanium, boron or others are named, this should be understood in the context of the present disclosure such that not only the pure alloy elements can be used, but also compounds are included that contain the respectively named alloy elements. The stated amount of silicon of maximal 12.5 percent by weight relates to the total weight of the first grain refiner.

In an embodiment the first grain refiner can contain silicon with 3.0 to 7.0 percent by weight, magnesium with 0.2 to 0.7 percent by weight, titanium with 0.07 to 0.12 percent by weight, boron with maximal 0.012 percent by weight, optionally further alloy elements with together less than 1.5 percent by weight, the rest aluminium as well as unavoidable impurities. In this case, the named values relate to the total weight of the first grain refiner. The first grain refiner can have the same or a different alloy composition as the base melt. According to a possible embodiment, the first grain refiner is treated in the molten state with ultrasonic sound, so that during solidification a globular formed-in mixed crystal is produced. This means that the amount of silicon dissolved in the aluminium forms a globular formed-in mixed crystal. The heating of the grain refiner takes place in particular up to the transition temperature between solid and liquid (semi-solid) or above. A further effect of the ultrasonic treatment is, that the boron contained in the grain refinement melt and/or the boride serve as nucleus, on which Al3Ti attaches. During the cooling the so formed Al3Ti-particles solidify in the equiaxed structure. Preferably, the first grain refinement melt is as quickly as possibly solidified, i.e., for example within up to 10 seconds. Later on, when stirring the Al3Ti-particles into the base melt, the nucleation takes place.

The second grain refiner on the basis of an aluminium-titanium alloy can in particular be a commercial grain refiner, like for example Al5Ti1B.

The first and second grain refiner can be added individually or as a composite grain refinement system into the base melt, wherein the nucleus forming first grain refiner and the nucleus forming second grain refiner are completely melted in the melt. Then, the melt resulting therefrom, which is composed of the base melt with the grain refiners melted therein, is poured into the casting tool and/or forming tool.

According to a possible process embodiment, the first and second grain refiner can be added to the base melt directly before casting the respective casting component. In a more detailed embodiment, it can be provided in particular that the casting of the melt into the casting tool takes place within in particular maximal five minutes after the stirring-in of the first grain refiner and/or of the second grain refiner into the base melt. In this manner, the Al3Ti-particles of the added grain refiners are at least essentially present in solid state, so that the grain refinement effect is increased.

BRIEF DESCRIPTION OF THE DRAWINGS

An example process embodiment is described in the following using the drawings.

DESCRIPTION

Figure 1:
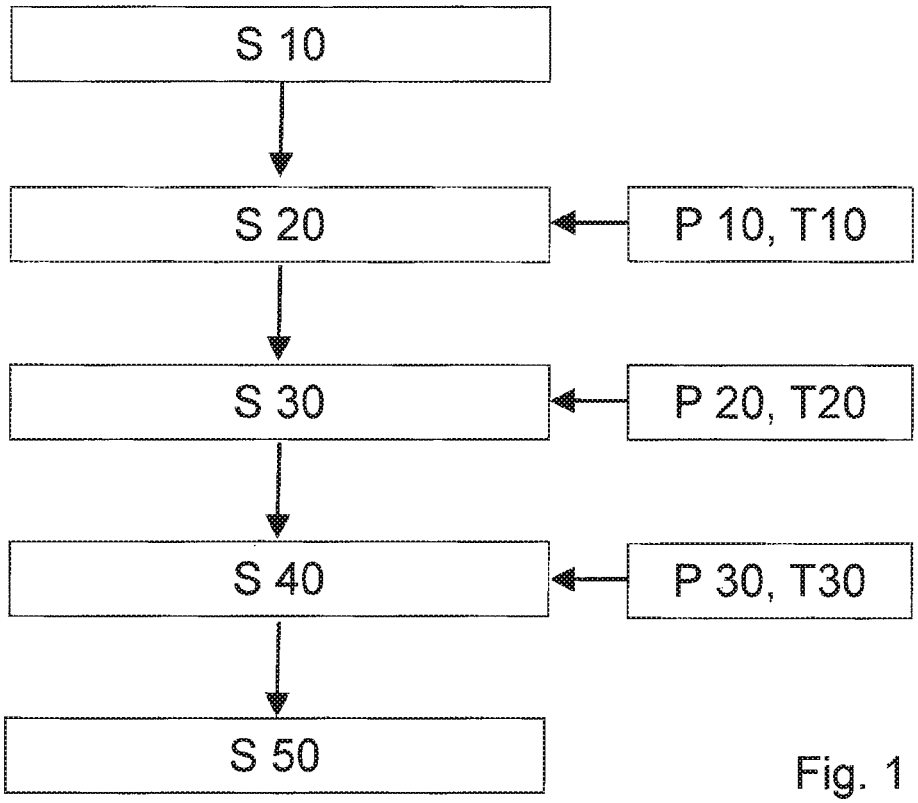
FIG. 1 illustrates a method for producing a light metal cast component by means of a casting and forming tool with the method steps S10 to S50.
Figure 2:
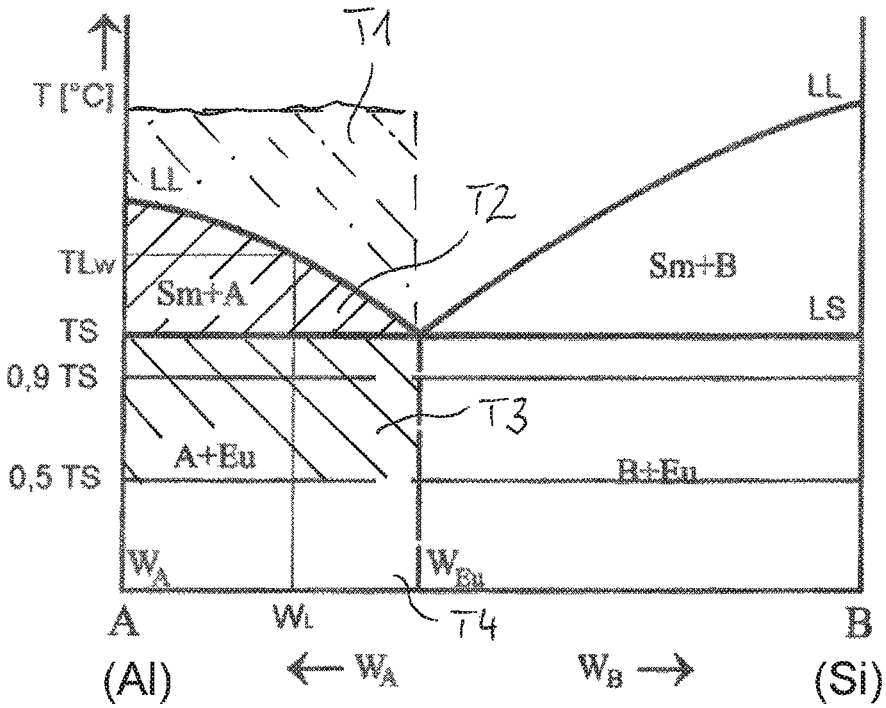
FIG. 2 illustrates a phase diagram for a metal alloy for producing a component according to the method of FIG. 1.

FIGS. 1 and 2 are described together in the following. FIG. 1 shows a method for producing a light metal cast component by using a casting and forming tool in several method steps S10 to S50.

As a material a light metal cast alloy is used, which contains at least the following alloying components: 3.5 to 5.0 percent by weight silicon, 0.2 to 0.7 percent by weight magnesium, 0.07 to 0.12 percent by weight titanium, a measurable amount of boron of up to 0.012 percent by weight, at least 93.0 percent by weight aluminium as well as unavoidable impurities. Furthermore, the alloy can contain in low amounts traces of further elements like copper, manganese, nickel, zinc, tin and/or strontium.

An exemplary alloy can have in particular 4.0 percent by weight silicon, 0.4 percent by weight magnesium, 0.08 percent by weight titanium, 0.012 percent by weight boron, approximately 400 ppm copper (Cu), approximately 400 ppm zinc (Zn), approximately 100 ppm strontium (Sr), approximately 200 ppm tin (Sn), approximately 400 ppm nickel (Ni), approximately 400 ppm manganese (Mn), further unavoidable impurities and the rest aluminium (Al).

In the first method step S10, the melt is produced for producing the light metal cast component. For this, a base melt is made from a base alloy. At least one grain refiner can be added to the base alloy, which acts as nucleating agent during crystallisation. In concrete terms, as an example, a first grain refiner of an aluminium-silicon-alloy can be used that contains an amount of silicon of up to 12.5 percent by weight in relation to the total weight of the first grain refiner alloy. Additionally a second grain refiner of an aluminium-titanium-alloy can be used, which contains as a main component aluminium and as additional alloy elements at least titanium and boron. The grain refiners are added to the melt of the base alloy, wherein the grain refiners are melted. Concerning the proportions it is especially provided that an amount of in total 0.1 to 5.0 percent by weight of the first and second grain refiner relative to the total weight of the to be produced component are added.

In the second method step S20, the melt of the light metal casting alloy is poured into a casting- and forming tool at a low first pressure (P1). The casting can be carried out by gravity casting or low pressure casting, wherein the first pressure (P1) is preferably below 1.0 MPa. The melt is poured with a temperature (T1) above the liquidus temperature, in particular at a temperature of 650° C. to 780° C. The casting tool, which can also be designated as casting mold or permanent mold, can have in contrast thereto a low temperature of for example below 300° C.

In the following method step S30, an application of pressure onto the light metal alloy contained in the hollow mold space is carried out. For this, a pressure P2 is produced between a lower part and an upper part of the casting tool, which is larger than 5 MPa (50 bar). This pressure can for example be produced by the dead weight of the upper part. Before the pressure application, all openings of the casting and forming tool are to be closed, so that no material is unwantedly pressed out of the mold. The pressure application to the melt can be carried out at a component-surface-layer-temperature range T2 starting from around the liquidus line TL up to above the solidus line TS of the metal alloy, i.e., TS<T2<TL. Before the pressure application the material is still liquid. After completion of the pressure application, the material is at least partially solidified, i.e., it is in a semi-solid-state.

After the pressure application (S30), in the following method step (S40) a compacting of the component that is at least mostly solidified from the melt is carried out. The compacting is effected by relative movement of the lower part relative to the upper part at a third pressure P3 that is larger than the second pressure P2 in method step S30. The compacting can be carried out by pressing the lower part in direction of the upper part with high forces. The compacting possibly starts only then, when the metal alloy is at least mostly solidified, i.e., is in a semi-solid-state. The compacting can take place at a component-surface-layer-temperature T3 which is lower than the temperature T2 of the metal alloy at the method step of the pressure application S30. As a lower boundary for the temperature T3, half the solidus temperature TS of the metal alloy is identified, i.e. T2>T3>0.5 TS. The end of the forming process is defined by the reaching of an end position of the relative movement of the upper part relative to the lower part and the reaching of a specific temperature. During the compacting, the component experiences only a comparable low deformation of less than 15%, in particular less than 10%, respectively 5%. During the compacting the pores in the component are closed, so that the microstructure is improved.

After the component is completely solidified, it is removed from the casting tool. Following this, the component, which is also referred to as cast blank in this condition, is mechanically finished in method step S50. The mechanical finishing can for example be a machining process, such as a turning or milling process, or a forming process, like flow-forming.

After the solidification, the light metal cast component can be subjected to a heat treatment before or after the mechanical processing. For example, the cast light metal component can be solution annealed and then tempered. Due to the heat treatment, in particular the strength properties of the component can be increased.

Further common method steps like quality control, for example by means of x-raying, as well as varnishing can be carried out.

By means of the disclosed method, cast blanks can be produced in several steps in the same lower mold, by means of casting (S20), following pressure application (S30) and following compacting/forming (S40). The pressure application takes place above the solidus temperature (liquid to semi-solid-state) of the respectively used alloy.

FIG. 2 shows a condition diagram (phase diagram) for a light metal alloy for producing a component in line with the method according to the invention. On the X-axis the proportion of a metal alloy ($W_L$) is given, which contains $X_A$% of a metal A and $X_B$% of a metal B. In the present case, the metal A is aluminium and the metal B is silicon. Due to the named proportions of aluminium and silicon, the light metal alloy formed therefrom is hypoeutectic, that means the proportion of silicon (metal B) in relation to aluminium (metal A) is so low in the light metal alloy ($W_L$), that a structure is achieved left of the eutectic ($W_{Eu}$).

On the Y-axis the temperature (T) is given. The casting takes place at a temperature T1 clearly above the liquidus temperature TL and/or the liquidus line LL. The temperature range T1 is shown dash-dottedly. The temperature range T2 for the pressure application, which is preferably below the liquidus temperature (TL) and above the solidus temperature TS (TL>T2>TS), is shown in FIG. 2 with a hatching from left below to the right above. In dependency of the process time during the pressure application (S20), the residual deformation degree with less than 15% remains for a following compacting. The compacting (S30) takes place in particular at a temperature range T3 between the temperature T2 and half of the solidus temperature 0.5TS (T2>T3>0.5TS). This range is shown hatched in FIG. 2 from left above to the right below. Optionally, a mechanical post-processing (S40) takes place at a temperature T4 below the solidus temperature (T4<TS).

The cast light metal component produced with the named method has an especially fine grained structure with a low porosity as well as good mechanical properties, in particular in view of the strength, ductility and elongation at fracture. The light metal cast component has a maximal porosity of less than 0.5%, in particular less than 0.1%, and a surface roughness (Ra) of less than 50 micrometers, in particular less than 20 micrometers. The tensile strength (Rm) of the light metal cast component is after the carried out heat treatment at least 270 $N/mm^2$, in particular at least 320 $N/mm^2$. The elongation at fracture (A5) is at least 5%, in particular at least 8%. The yield strength (Rp0.2) is at least 200 $N/mm^2$, in particular at least 280 $N/mm^2$.

The light metal cast component can be configured in the form of a safety- or structural component for a motor vehicle, in particular as a vehicle wheel, respectively a vehicle rim. The method is especially suitable for producing safety- or structural components with a weight of at least 500 grams, in particular at least 3000 grams, without being limited thereto.

An advantage of the described method is, that a component produced therewith has an especially fine grained structure nearly free of cavities. This leads altogether to an increased strength of the component. Thus, tests have shown, that the tensile strength (Rm) of a component produced according to the invention was increased compared to components produced in the common manner by more than 20%. The yield strength (Rp0.2) was even increased by more than 40%. Thus, overall, a component with higher strength can be produced with the same material consumption, or a lighter component can be produced with a lower material consumption.

The invention claimed is:

1. A method for producing a light metal cast component, comprising:

providing a melt from an aluminium casting alloy that includes silicon of 3.5 to 5.0 percent by weight, magnesium of 0.2 to 0.7 percent by weight, titanium of 0.07 to 0.12 percent by weight, boron of at most 0.012 percent by weight, wherein the melt is produced from a base melt that contains aluminium, a first grain refiner of an aluminium-silicon-alloy that contains a proportion of silicon of at most 12.5 percent by weight, and aluminium, and a second grain refiner of an aluminium-titanium-alloy that contains as alloy elements at least titanium, boron and aluminium, wherein the melt, in relation to a total weight, contains in total an amount of 0.1 to 5.0 percent by weight of the grain refiner of the aluminium-silicon-alloy and of the grain refiner of the aluminium-titanium-alloy;

casting the melt into a casting- and forming tool at a low first pressure by means of gravity casting or low-pressure casting;

after completely filling the casting and forming tool, applying a pressure to the solidifying melt in the casting and forming tool with a second pressure that is larger than the first pressure; and when the melt is at least mostly solidified to the component, compacting the component that is at least mostly solidified from the melt in the casting and forming tool at a third pressure that is larger than the second pressure.

2. The method of claim 1, wherein the melt contains as further alloy elements at least one of:

strontium (Sr) with 100 to 150 parts per million,
tin (Sn) with less than 250 parts per million,
copper (Cu) with less than 1.0 percent by weight,
nickel (Ni) with less than 550 parts per million,
titanium boride with less than 30 parts per million,
zinc (Zn) with less than 550 parts per million,
chromium (Cr) with less than 500 parts per million,
iron (Fe) with less than 0.7 percent by weight, and
manganese (Mn) with less than 0.15 percent by weight.

3. The method of claim 1, wherein the first grain refiner is produced by producing a grain refinement melt from the aluminium-silicon-alloy and treating the grain refinement melt with ultrasonic sound, such, that after the solidification, a globule-like formed-in alpha-mixed crystal is present.

4. The method of claim 1, wherein the first grain refiner and the second grain refiner are introduced into the base melt by stirring.

5. The method of claim 1, wherein the casting of the melt takes place at most five minutes after introduction of at least one of the first grain refiner and the second grain refiner.

6. The method of claim 1, wherein the casting takes place at a first temperature of 620° C. to 800° C.

7. The method of claim 1, wherein the pressure application with the second pressure is carried out at a second temperature that is lower than the first temperature and is below the liquidus line, wherein the compacting with the third pressure is carried out at a third temperature that is lower than the second temperature and that is at least half of the solidus temperature of the aluminium casting alloy.

8. The method of claim 1, wherein the light metal cast component is subjected to a heat treatment after the solidification.

9. The method of claim 1, wherein the melt includes further alloy elements that are less than 1.5 percent by weight, the remainder being aluminium and unavoidable impurities.

10. A light metal cast component produced by:

providing a melt from an aluminium casting alloy that includes silicon of 3.5 to 5.0 percent by weight, magnesium of 0.2 to 0.7 percent by weight, titanium of 0.07 to 0.12 percent by weight, boron of at most 0.012 percent by weight, wherein the melt is produced from a base melt that contains aluminium, a first grain refiner of an aluminium-silicon-alloy that contains a proportion of silicon of at most 12.5 percent by weight, and aluminium, and a second grain refiner of an aluminium-titanium-alloy that contains as alloy elements at least titanium, boron and aluminium, wherein the melt, in relation to a total weight, contains in total an amount of 0.1 to 5.0 percent by weight of the grain refiner of the aluminium-silicon-alloy and of the grain refiner of the aluminium-titanium-alloy;

casting the melt into a casting and forming tool at a low first pressure by means of gravity casting or low-pressure casting;

after completely filling the casting and forming tool, applying a pressure to the solidifying melt in the casting and forming tool with a second pressure that is larger than the first pressure; and when the melt is at least mostly solidified to the component, compacting the component that is at least mostly solidified from the melt in the casting and forming tool at a third pressure that is larger than the second pressure;

wherein the light metal cast component contains 3.5 to 5.0 percent by weight silicon and 0.2 to 0.7 percent by weight magnesium, 0.07 to 0.12 percent by weight titanium, at most 0.012 percent by weight boron; and wherein the light metal cast component has an average grain size of at most 500 micrometers.

11. The light metal cast component of claim 10, wherein the light metal cast component has a maximal porosity of less than 0.5%.

12. The light metal cast component of claim 10, wherein the light metal cast component has an elongation at fracture of at least 5%.

13. The light metal cast component of claim 10, wherein the light metal cast component has a yield strength of at least 220 Newton per square millimeter.

14. The light metal cast component of claim 10, wherein the light metal cast component has a tensile strength of at least 270 Newton per square millimeter.

15. The light metal cast component of claim 10, wherein the light metal cast component has a surface roughness of less than 50 micrometers.

16. The light metal cast component of claim 10, wherein the light metal cast component has a yield strength of at least 280 Newton per square millimeter, an elongation at fracture of at least 8% and a tensile strength of at least 320 Newton per square millimeter in the area of a cast blank surface.

17. The light metal cast component of claim 10, wherein the light metal cast component has partial portions in the finished state that are mechanically unmachined after the casting, wherein the mechanically unmachined partial portions have a wall thickness of less than 3.0 millimeters.

18. The light metal cast component of claim 10, wherein the light metal cast component is a safety- or structural component of a motor vehicle.

19. The light metal cast component of claim 18, wherein the safety or structural component has a weight of at least 500 grams.

20. The light metal cast component of claim 10, wherein the melt includes further alloy elements that are less than 1.5 percent by weight, the remainder being aluminium and unavoidable impurities.

* * * * *